US006009962A

United States Patent [19]

Beaton

[11] Patent Number: 6,009,962

[45] Date of Patent: Jan. 4, 2000

[54] IMPREGNATED TYPE ROTARY DRILL BITS

[75] Inventor: Timothy P. Beaton, Houston, Tex.

[73] Assignee: Camco International (UK) Limited, United Kingdom

[21] Appl. No.: 08/900,910

[22] Filed: Jul. 28, 1997

Related U.S. Application Data

[60] Provisional application No. 60/022,922, Aug. 1, 1996.

[51] Int. Cl.[7] ..... E21B 10/46

[52] U.S. Cl. ..... 175/426; 175/434

[58] Field of Search ..... 175/434, 426, 175/428, 405.1, 420.2

[56] References Cited

U.S. PATENT DOCUMENTS

| | | | |
|---|---|---|---|
| 2,371,488 | 3/1945 | Williams, Jr. | 175/405.1 |
| 3,537,538 | 11/1970 | Generoux | 175/379 |
| 3,709,308 | 1/1973 | Rowley et al. | 175/434 |
| 3,885,637 | 5/1975 | Veprintsev et al. . | |
| 3,938,599 | 2/1976 | Horn | 175/434 |
| 4,200,159 | 4/1980 | Peschel et al. . | |
| 4,266,621 | 5/1981 | Brock . | |
| 4,350,215 | 9/1982 | Radtke . | |
| 4,351,401 | 9/1982 | Fielder . | |
| 4,554,986 | 11/1985 | Jones . | |
| 5,090,491 | 2/1992 | Tibbitts et al. | 175/426 |

FOREIGN PATENT DOCUMENTS

| | | | |
|---|---|---|---|
| 0169683 | 1/1986 | European Pat. Off. . | |
| 0314953 | 5/1989 | European Pat. Off. . | |
| 0151340 | 10/1981 | German Dem. Rep. | 175/405.1 |
| 1227801 | 4/1986 | U.S.S.R. | 175/405.1 |

OTHER PUBLICATIONS

R.J. Gentges: "Proper bit design improves penetration rate in abrasive horizontal wells", *Oil and Gas Journal* Aug. 9, 1993, vol. 91 No. 32, pp. 39–42.

*Primary Examiner*—Hoang Dang

*Attorney, Agent, or Firm*—Tobor, Goldstein & Healey, L.L.P.

[57] ABSTRACT

A rotary drill bit comprises a bit body having a leading surface formed at least in part from solid infiltrated matrix material, a major part of the leading surface being impregnated with abrasive particles of diamond or other superhard material. There are also mounted at the leading surface a plurality of larger cutting elements having cutting edges formed of superhard material which project above the surface, the larger cutting elements being so spaced as to define a substantially continuous cutting profile, so that the cutting elements in combination sweep over the whole of a bottom of a hole being drilled by the bit, during each revolution. The abrasive particles normally carry out the majority of the drilling action in hard formations, but the larger cutting elements serve to cut more rapidly through temporary obstructions which may be encountered in the borehole, such as a shoetrack.

11 Claims, 2 Drawing Sheets

IMPREGNATED TYPE ROTARY DRILL BITS

This application claims benefit of provisional appln. 60/022,922 filed Aug. 1, 1996.

BACKGROUND OF THE INVENTION

1. Field of the Invention

The invention relates to rotary drill bits for drilling in subsurface formations and of the kind comprising a bit body having a leading surface formed at least in part from solid infiltrated matrix material, at least a major part of the leading surface being impregnated with a plurality of abrasive particles of superhard material. Such bits are commonly referred to as impregnated or "impreg" bits.

2. Description of Related Art

As is well known, such a drill bit usually comprises a steel core around which the main part of the bit body, providing its leading face, is formed by a powder metallurgy process. In this process the steel core is located in an appropriately shaped mould which is then packed with particulate matrix-forming material, usually powdered tungsten carbide. A solid body of suitable copper or other alloy is placed above the packed particulate material and the whole assembly is placed in a furnace so that the alloy fuses and infiltrates downwardly through the carbide particles so as to form, upon cooling, a body of solid infiltrated matrix material in the shape of the mould. The abrasive particles with which the matrix material is impregnated commonly comprise small bodies of natural or synthetic diamond, the latter usually being in the form of single crystals although bodies of thermally stable polycrystalline diamond may also be employed. The abrasive particles are located within appropriate parts of the mould before it is packed with the matrix-forming particles.

Such impregnated drill bits are particularly suitable for drilling through very hard subsurface formations. However, when drilling a borehole, the situation often arises where a partly completed borehole is wholly or partly blocked and it is necessary to drill out the blockage before a new portion of the borehole can be drilled. Thus it may be necessary to drill out items such as plugs, floats, float collars, shoes, shoetracks or liner hanger equipment. For example, in order to inject cement into the spaces between the casing of a section of borehole and the surrounding formation it is common to pump the cement down the interior of the casing followed by a column of drilling fluid, so that the pressure of the drilling fluid forces the cement upwardly around the casing from below. A shoetrack is a device, formed mainly from aluminium, rubber and cement, which is used to separate the drilling fluid from the cement, and which remains at the bottom of the borehole section, blocking it, after the cementing operation has been completed. The shoetrack must therefore be drilled out before drilling of a further section of the borehole can be resumed.

However, the cutting structure of an impregnated drill bit is not suitable for the rapid drilling out of temporary obstructions in the borehole of the kind described above, being designed to perform a comparatively slow grinding away of very hard subsurface formations. Hitherto therefore, where it has been desired to use an impregnated bit to drill the borehole, it has been necessary to drill out the shoetrack, or other blocking structure in the borehole, with a different type of drill bit before continuing to drill the borehole itself with the impregnated bit. The tripping of a drill bit into and out of an existing borehole is costly and it would therefore be advantageous to employ a drill bit which is capable both of drilling out the shoetrack or other obstruction and then continuing to drill the borehole in the formation. However, conventional drill bits which may be capable of drilling out the obstruction, such as some types of drag-type drill bits or roller cone bits, may be much less effective than an impregnated bit for subsequently drilling the hard formation.

The present invention therefore sets out to provide an improved form of impregnated drill bit which may also be capable of drilling out shoetracks or similar devices which may temporarily obstruct a borehole.

SUMMARY OF THE INVENTION

According to the invention there is provided a rotary drill bit comprising a bit body having a leading surface formed at least in part from solid infiltrated matrix material, a major part of said leading surface being impregnated with a plurality of abrasive particles of superhard material, and wherein there are also mounted at said leading surface a plurality of larger cutting elements having cutting edges formed of superhard material which project above said surface, said cutting elements being so spaced over the leading surface as to define a substantially continuous cutting profile, so that the cutting elements in combination sweep over the whole of a bottom of a hole being drilled by the bit, during each revolution thereof.

It has occasionally been the practice to supplement the abrasive particles of an impregnated drill bit by larger cutters in the central region of the leading face of the drill bit, adjacent the central longitudinal axis. For example, adjacent the axis the abrasive particles have been supplemented by larger rectangular or triangular blocks of thermally stable polycrystalline diamond having an outer face which is substantially flush with the surface of the drill bit. The purpose of such elements is to enhance the cutting action of the impregnated bit in the central area where the linear speed of the elements is significantly less than the speed of the abrasive particles nearer the periphery of the drill bit. However, such prior art arrangements are not capable of drilling out a device providing temporarily obstruction of the borehole since the additional elements are only located in the central region and they are not, in any case, of such a kind as to provide for effective drilling of such obstructions.

In arrangements according to the present invention the additional larger cutting elements are so arranged and located that they will cut through any obstruction in the borehole comparatively rapidly. Thereafter engagement of the drill bit with the hard formation causes the additional cutting elements to be rapidly worn down to the surface of the drill bit so that the bit then continues to drill as a normal impregnated drill bit.

The additional cutting elements may be formed from thermally stable polycrystalline diamond material and are partly embedded in said solid infiltrated matrix material. As is well known "thermally stable" polycrystalline diamond material is material which is thermally stable at the sort of temperatures usually employed in the process by which drill bits are moulded by infiltration of powdered tungsten carbide or similar matrix-forming material. Such thermally stable diamond material may be formed, for example, by leaching out the cobalt which is normally present in the interstices between the diamond particles of non-thermally stable polycrystalline diamond material. The latter material may begin to suffer thermal degradation at temperatures greater than about 700° C., whereas thermally stable polycrystalline diamond material may be able to sustain temperatures up to around 1100° C.

Other forms of thermally stable polycrystalline diamond materials are also available, including materials (sold under the Trade Mark "Syndax") where the matrix/binder for the diamond comprises silicon carbide rather than cobalt, and does not require leaching out. Rare earth binder/catalysts may also be used.

The use of thermally stable polycrystalline diamond for the cutting elements allows these elements to be placed in the mould before it is packed with matrix-forming material, so that the elements are partly embedded in the moulded body, so as to project therefrom, during the moulding process. Also, after the impregnated drill bit has been used to drill through a temporary obstruction in the borehole, the thermally stable cutting elements will be rapidly worn down to become flush with the surface of the drill bit, as a result of abrasion from the hard formation, but they will then continue to act as abrasion elements on the hard formation, contributing to the effective drilling action of the bit.

Although cutting elements in the form of thermally stable polycrystalline diamond may be preferred, for the reasons set out above, the present invention does not exclude the provision of other types of cutting element employing superhard materials, such as conventional polycrystalline diamond compact cutting elements. Such cutting elements comprise a front facing table of polycrystalline diamond bonded to a substrate of less hard material, such as cemented tungsten carbide. The substrate of the cutting element, or a stud or post to which it may be brazed, is secured, by brazing or shrink fitting, within a socket in the bit body. However, cutting elements of this kind may have the disadvantage that, once the cutting structure is worn down to the surface of the bit body, the remaining exposed surface of the cutting element may be constituted wholly or partly by the material of the substrate or support post, usually tungsten carbide, which may not make an effective contribution to the abrasion of the formation.

Each cutting element may comprise a generally cylindrical portion, which may be of circular cross-section, providing a cutting surface which projects at an angle from the leading surface of the bit body, and may also include an additional mounting portion which projects into the matrix material of the bit surface. The mounting portion may be generally conical or cylindrical and coaxial with the cylindrical portion.

In any of the arrangements according to the invention the leading surface of the bit body may comprise a plurality of lands separated by channels for drilling fluid which extend outwardly to the outer periphery of the drill bit. Preferably said cutting elements are provided on only a minority of said lands. The lands on which the cutting elements are provided may also be impregnated with said abrasive superhard particles, particularly in the preferred case where the cutting elements comprise thermally stable polycrystalline diamond.

DETAILED DESCRIPTION OF THE PREFERRED EMBODIMENT

Figure 1:
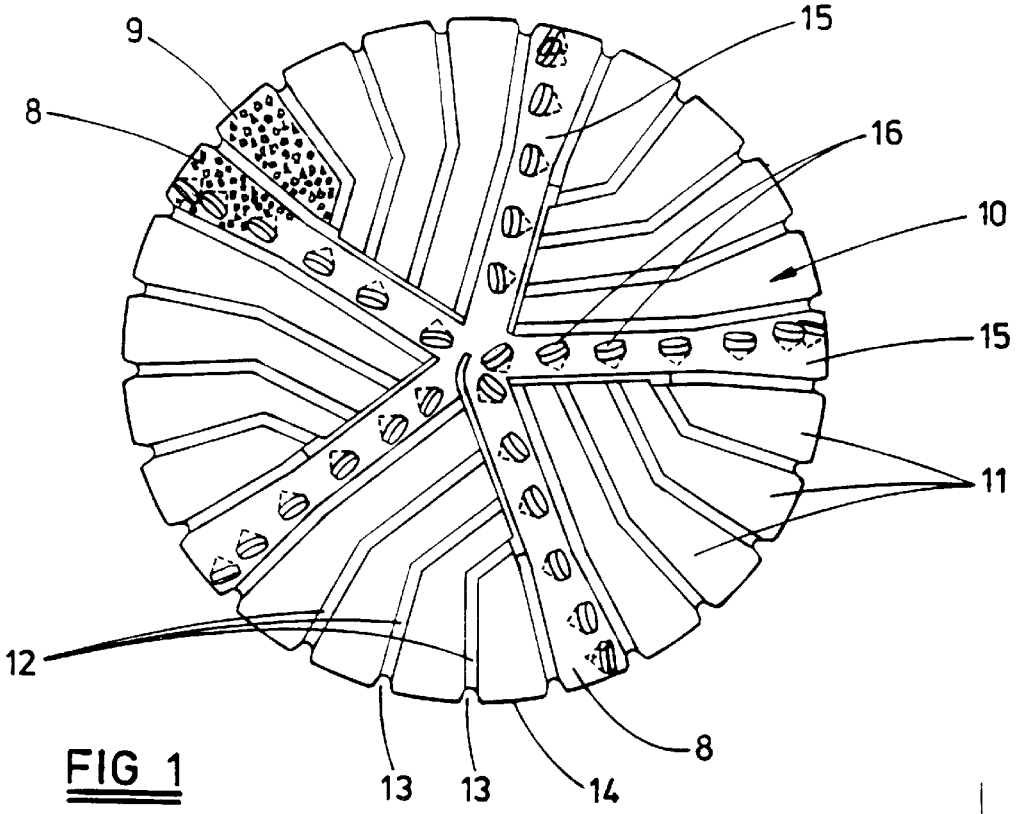
FIG. 1 is a diagrammatic end view of the leading face of an impregnated drill bit in accordance with the present invention.

Referring to FIG. 1, the drill bit has a leading surface 10 on the main body of the bit which is formed in a mould using well known powder metallurgy techniques. The leading surface is formed with a plurality of outwardly extending lands 11 separated by narrow flow channels 12 which lead to junk slots 13 which extend generally axially upwardly along the gauge portion 14 of the drill bit.

The outer surfaces of the lands 11, which cover the major part of the area of the leading face of the drill bit, are impregnated in known manner with a large number of abrasive particles of superhard material 9 (only a few of which are shown in FIG. 1), which may be natural or synthetic diamond, so as to provide the main formation-abrading surfaces of the drill bit. The particles 9 are impregnated into the bit body by applying a layer of tungsten carbide paste, in which the particles are suspended, to the interior surface of the mould along the surfaces corresponding to the lands 11, before the mould is packed with the dry particulate tungsten carbide material for infiltration in the forming process. This form of construction of impregnated drill bits is well known and will not therefore be described in further detail.

In addition to the main lands 11, the leading surface 10 of the bit is also formed with five further lands 15 which are substantially equally spaced and extend generally radially from the centre of the leading face to the periphery. A number of larger cutters 16 are spaced apart along each radial land 15.

Figure 3:
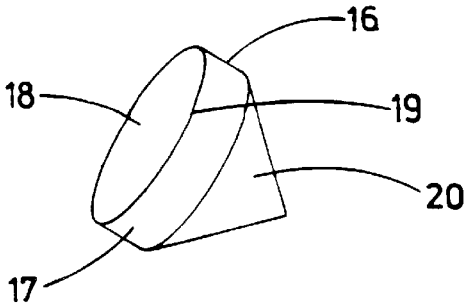
FIG. 3 is a diagrammatic perspective view of one of the thermally stable cutting elements employed on the drill bit.
Figure 4:
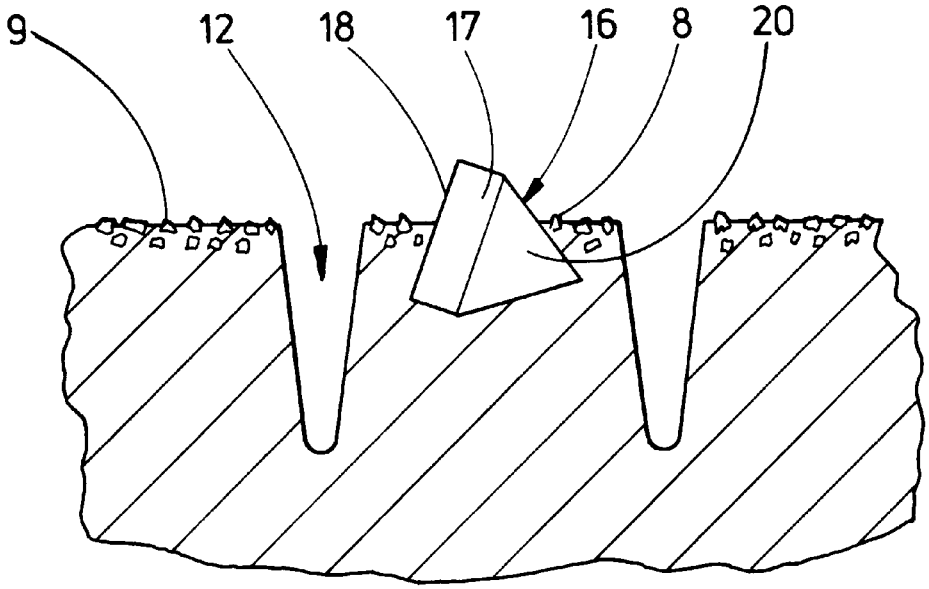
FIG. 4 is a diagrammatic section through one of the thermally stable cutting elements, showing it mounted on the drill bit.

The cutters 16 are shown only diagrammatically in FIG. 1 and, as better seen in FIGS. 3 and 4, each cutter comprises a generally cylindrical main portion 17, providing a front cutting face 18 and a peripheral cutting edge 19, and a conical mounting portion 20 extends integrally from the rear surface of the cylindrical portion.

Each cutting element 16 is moulded from thermally stable polycrystalline diamond, as previously described. The methods involved in the manufacture of bodies of thermally stable polycrystalline diamond are well known and will not therefore be described in further detail.

The cutting elements 16 are also located in appropriate positions within the mould before it is packed with matrix forming material, so that once such material has been infiltrated, the mounting portion 20 and part of the cylindrical portion 17 of each cutter is partly embedded in the matrix material of the bit body so that the cutting face 18 and part of the cutting edge 19 of each cutter projects at an angle above the surface of the land 15 on which the cutter is mounted, as shown in FIG. 4.

Figure 5:
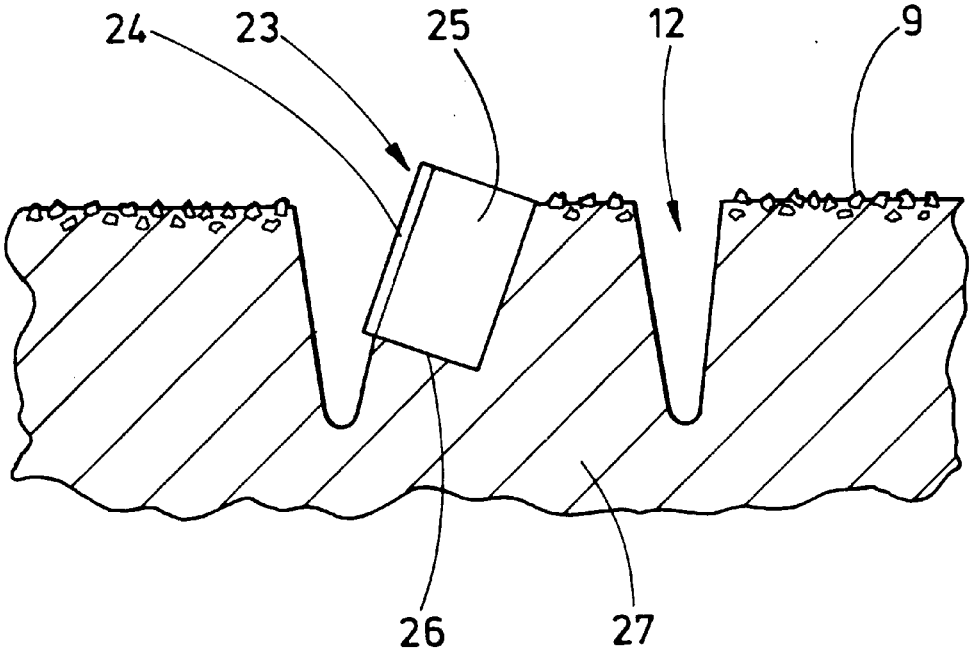
FIG. 5 is a similar view to FIG. 4, showing the use of an alternative, non-thermally stable, polycrystalline diamond compact cutter.

As previously mentioned the drill bit according to the invention may also employ non-thermally stable cutters instead of the thermally stable cutters shown in FIGS. 1, 3 and 4. The non-thermally stable cutters may, for example, be polycrystalline diamond compact (pdc) cutters, as shown at 23 in FIG. 5. As is well known, such cutters comprise a circular front facing table 24 of polycrystalline diamond or other superhard material, bonded in a high pressure, high temperature press to a cylindrical substrate 25 of less hard material, usually cemented tungsten carbide. The substrate 25 may, as shown in FIG. 5, be of sufficient length that it can be retained in a socket 26 in the bit body 27. Alternatively, the substrate of each cutter may be brazed to a cylindrical stud or post which is-then secured within the socket.

Since pdc cutters are not thermally stable, they cannot normally be secured in the matrix bit body by moulding the matrix material around them. The sockets 26 in which the cutters are received are therefore preformed in the matrix material by placing suitably shaped graphite formers in the mould, around which the matrix is formed. After the bit body has been formed in the mould the formers are removed and the cutters are brazed or shrink-fitted into the sockets so formed in the matrix.

In a manner which is well known in conventional drag type drill bits incorporating discrete polycrystalline diamond cutters, the cutters 16 or 23 are so located and orientated on their respective lands that all of the cutters on the drill bit together define a substantially continuous cutting profile, so that the cutters in combination sweep over the whole of the bottom of a hole being drilled by the bit during each rotation thereof.

Figure 2:
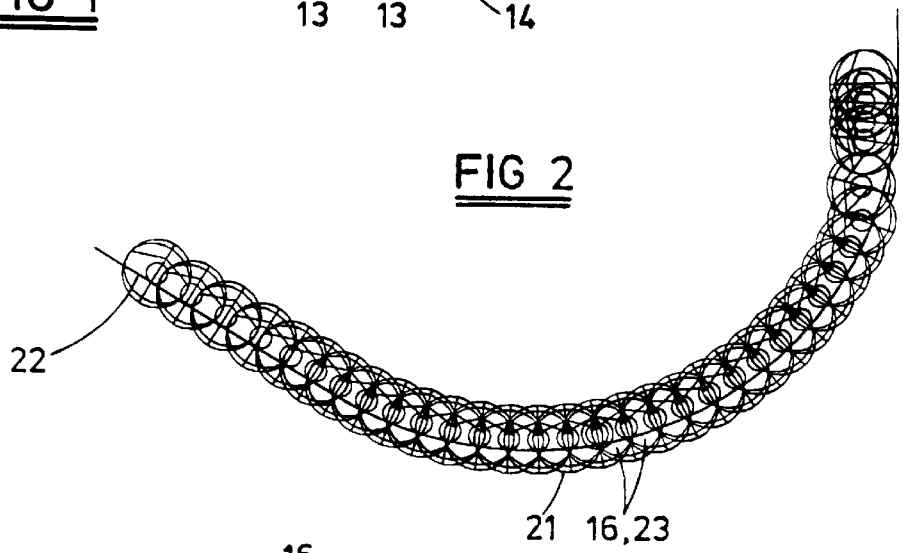
FIG. 2 is a diagrammatic representation of the cutting profile provided by the cutting elements of the drill bit.

FIG. 2 shows diagrammatically at 21 the cutting profile swept by the cutters 16 or 23, the level of the surfaces of the lands 15 above which the cutters 16 or 23 project being indicated diagrammatically at 22.

As previously described, a drill bit of the kind shown in FIGS. 1–3 may be employed to drill out a shoetrack or similar temporary obstruction in a partly-drilled borehole, before subsequently continuing to extend the borehole.

When the drill bit engages the shoetrack or other obstruction, the obstruction is cut away, as the bit rotates, by the projecting cutters 16 or 23 which are effective across the whole diameter of the borehole. Once the obstruction has been drilled away the drill bit engages the formation at the bottom of the hole and begins to drill that formation. In the course of such drilling the projecting portions of the cutters 16 or 23 will be worn away comparatively rapidly, due to the hardness of the formation, so that eventually the cutters are worn substantially flush with the surface of the lands 15 in which they are mounted. The bit continues then to drill as a conventional impregnated drill bit, most of the drilling action being effected by the superhard particles impregnated on the lands 11, but some contribution also being made by the worn down cutters 16 or 23.

The lands 15 may also be impregnated with superhard particles, similar to those on the lands 11, such particles in that case surrounding the additional larger cutters 16 or 23. A few such further particles are indicated at 8 in FIG. 1.

The invention thus allows a single drill bit both to drill out an obstruction and to continue drilling the hard formation, thus avoiding the cost of two successive downhole trips to allow different drill bits to perform the two different functions.

Whereas the present invention has been described in particular relation to the drawings attached hereto, it should be understood that other and further modifications, apart from those shown or suggested herein, may be made within the scope and spirit of the present invention.

What is claimed:

1. A rotary drill bit, comprising:

a bit body having a leading surface formed at least in part from solid infiltrated matrix material, the leading surface including a plurality of lands;

a major part of the leading surface being impregnated with a plurality of abrasive particles of super hard material; and a plurality of cutting elements, larger than the abrasive particles, mounted at the leading surface, the plurality of cutting elements having cutting edges formed of super hard material, the cutting edges projecting above the leading surface and being spaced over the leading surface to define a substantially continuous cutting profile, with the cutting elements only being mounted on a minority of the lands, whereby the plurality of cutting elements in combination sweep over substantially all of the bottom of a hole being drilled by the rotary drill bit, during each revolution of the rotary drill bit.

2. A rotary drill bit according to claim 1, wherein the abrasive particles are selected from natural and synthetic diamonds.

3. A rotary drill bit according to claim 1, wherein at least some of the additional cutting elements are formed from thermally stable polycrystalline diamond material and are partly embedded in said solid infiltrated matrix material.

4. A rotary drill bit according to claim 1, wherein at least some of the additional cutting elements each comprise a front facing table of superhard material bonded to a substrate of less hard material.

5. A rotary drill bit according to claim 4, wherein the superhard material is polycrystalline diamond.

6. A rotary drill bit according to claim 1, wherein each cutting element comprises a generally cylindrical portion, providing a cutting surface which projects at an angle from the leading surface of the bit body.

7. A rotary drill bit according to claim 6, wherein each cutting element also includes an additional mounting portion which projects into the matrix material of the bit surface..

8. A rotary drill bit according to claim 7, wherein the mounting portion is generally conical and coaxial with the cylindrical portion.

9. A rotary drill bit according to claim 7, wherein the mounting portion is generally cylindrical and coaxial with the cylindrical portion providing the cutting surface.

10. A rotary drill bit according to claim 1, wherein the plurality of lands are separated by channels for drilling fluid which extend outwardly to the outer periphery of the drill bit.

11. A rotary drill bit according to claim 10, wherein the lands on which the cutting elements are provided are also impregnated with said abrasive superhard particles.

* * * * *